US009932192B2

(12) United States Patent
Chanclón Fernández et al.

(10) Patent No.: US 9,932,192 B2
(45) Date of Patent: Apr. 3, 2018

(54) MEDIA STACKER TO RECEIVE MEDIA SHEETS

(71) Applicant: HEWLETT-PACKARD DEVELOPMENT COMPANY, L.P., Houston, TX (US)

(72) Inventors: David Chanclón Fernández, Barcelona (ES); Ricardo Sanchis Estruch, Barcelona (ES); Joan Sanjuán Mercadal, Barcelona (ES); Emilio López Matos, Barcelona (ES); Ignacio De Olazábal Zugasti, Barcelona (ES); Gianni Cessel, Rubi (ES); Xavier Alonso Becerro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/228,252

(22) Filed: Aug. 4, 2016

(65) Prior Publication Data

US 2016/0340142 A1 Nov. 24, 2016

Related U.S. Application Data

(63) Continuation of application No. 14/373,222, filed as application No. PCT/US2012/022624 on Jan. 26, 2012, now Pat. No. 9,446,926.

(51) Int. Cl.
*B65H 29/22* (2006.01)
*B65H 31/34* (2006.01)
(Continued)

(52) U.S. Cl.
CPC ..... *B65H 29/22* (2013.01); *B41F 13/64* (2013.01); *B41J 13/106* (2013.01); *B65H 29/50* (2013.01);
(Continued)

(58) Field of Classification Search
CPC ..... B65H 31/26; B65H 31/18; B65H 31/34; B65H 31/36; B65H 29/22; B65H 29/20; B65H 29/68
See application file for complete search history.

(56) References Cited

U.S. PATENT DOCUMENTS 4,019,730 A 4/1977 Staudinger et al.
5,934,664 A 8/1999 Murayama
(Continued)

FOREIGN PATENT DOCUMENTS

DE 3229926 2/1984
JP 04094369 A * 3/1992
(Continued)

OTHER PUBLICATIONS

European Patent Office, Communication pursuant to Article 94(3) EPC for EP Appl. No. 12866440.6 dated Nov. 18, 2015 (3 pages).
(Continued)

*Primary Examiner* — Luis A Gonzalez
(74) *Attorney, Agent, or Firm* — Trop, Pruner & Hu, P.C.

(57) ABSTRACT

In some examples, a media stacker includes a drawer defining a chamber, and a plurality of moving elements to engage media sheets of different sizes as the media sheets are output from a system. The plurality of moving elements are to slide the media sheets to a target position in the drawer, and the plurality of moving elements are to disengage from the media sheets once the media sheets have reached the target position. A plurality of retaining elements are to engage the media sheets of the different sizes as the media sheets slide into the drawer.

20 Claims, 6 Drawing Sheets

(51) Int. Cl.

| | |
|---|---|
| ***B65H 29/68*** | (2006.01) |
| ***B65H 31/26*** | (2006.01) |
| ***B41J 13/10*** | (2006.01) |
| ***B65H 31/10*** | (2006.01) |
| ***B65H 31/22*** | (2006.01) |
| ***B65H 31/36*** | (2006.01) |
| ***B65H 29/50*** | (2006.01) |
| ***B65H 31/04*** | (2006.01) |
| ***B41F 13/64*** | (2006.01) |
| ***B65H 31/02*** | (2006.01) |
| ***B65H 31/14*** | (2006.01) |

(52) U.S. Cl.

CPC ..... *B65H 29/68* (2013.01); *B65H 31/02* (2013.01); *B65H 31/04* (2013.01); *B65H 31/10* (2013.01); *B65H 31/14* (2013.01); *B65H 31/22* (2013.01); *B65H 31/26* (2013.01); *B65H 31/34* (2013.01); *B65H 31/36* (2013.01); *B65H 2404/1112* (2013.01); *B65H 2801/36* (2013.01)

(56) References Cited

U.S. PATENT DOCUMENTS

| | | | |
|---|---|---|---|
| 6,161,830 | A | 12/2000 | Yap |
| 6,634,639 | B2 | 10/2003 | Kuroda et al. |
| 6,682,067 | B1 | 1/2004 | Keane |
| 6,877,739 | B2 | 4/2005 | Leitz et al. |
| 7,165,765 | B2 | 1/2007 | Sonoda |
| 7,815,304 | B2 | 10/2010 | Ahn |
| 7,832,977 | B2 | 11/2010 | Brewer, III |
| 2004/0113354 | A1 | 6/2004 | Leitz |
| 2008/0123117 | A1 | 5/2008 | Kimura |
| 2014/0284873 | A1 | 9/2014 | Yamazaki |

FOREIGN PATENT DOCUMENTS

| | | | | |
|---|---|---|---|---|
| JP | 06127794 | A | * | 5/1994 |
| JP | 07109061 | | | 4/1995 |
| JP | 08058187 | | | 3/1996 |
| JP | 11147650 | | | 6/1999 |
| JP | 2009220951 | A | * | 10/2009 |
| KR | 20100050083 | | | 5/2010 |
| KR | 20110054590 | | | 5/2011 |
| WO | WO-2009025612 | | | 2/2009 |

OTHER PUBLICATIONS

European Patent Office, Communication under R.61 or R. 63 EPC for EP Appl. No. 12866440.6 dated Nov. 10, 2015 (5 pages).

Hit Print (HP), HP Designjet: Future-Ready Printing, Nov. 2011 (12 pages).

Korean Intellectual Property Office, International Search Report for PCT/US2012/022624 dated Oct. 16, 2012 (3 pages).

OCE North America, iHCS High Capacity Stacker Datasheet, Professional Finishing, Mar. 2010 (2 pages).

OCE, iHCS High Capacity Stacker—Specifications, Professional Finishing, Oct. 2008 (2 pages).

* cited by examiner

MEDIA STACKER TO RECEIVE MEDIA SHEETS

CROSS REFERENCE TO RELATED APPLICATIONS

This is a continuation of U.S. application Ser. No. 14/373,222, filed Jul. 18, 2014, which is a national stage application under 35 U.S.C. § 371 of PCT/US2012/022624, filed Jan. 26, 2012, which are both hereby incorporated by reference in their entirety.

BACKGROUND

A printer is used to print a target pattern onto a media sheet, such as a paper sheet, transparency sheet, and so forth. A printed media sheet can be output from the printer to an output tray or other receiving structure for user pickup.

BRIEF DESCRIPTION OF THE DRAWINGS

Some examples are described with respect to the following figures.

DETAILED DESCRIPTION

A printer has an output port through which a printed media sheet (e.g. a paper sheet, a transparency sheet, etc.) is output. With some printers, the output port can be provided at the front side of the printer to allow for convenient pickup of the printed media sheet by a user. In other examples, the output port of a printer can be provided at other locations of the printer.

Some printers are used in production environments that generate a relatively large number of printed media sheets. It may be desirable to provide the printed media sheets to a media stacker, where the printed media sheets can be held. Holding the printed media sheets in the media stacker allows for a printing operation to proceed without involving manual handling of each printed media sheet by a user as the printed media sheet is output from a printer. A media stacker has the ability to collect printed media sheets from the printer and to stack a certain quantity of the printed media sheets. At some point, a user can collect the stack of media sheets together, such that the user does not have to handle each media sheet individually as the media sheets are being printed.

In some examples, media stackers can have relatively large footprints. For example, a media stacker can be attached to the front side of the printer where the output port is located. Thus, in addition to the existing footprint of the printer, the footprint of the media stacker is added to the overall system that includes the printer and the external media stacker. An external media stacker that adds to the footprint of the printer can consume valuable real estate space of an enterprise, particularly in situations where the enterprise uses multiple printers in a defined amount of space. Also, in some examples, a media stacker may be located at a location that makes user tasks more difficult (such as loading new media sheets or a new media roll, performing a scan with a scanner at the printer, accessing an internal portion of the printer to address a media sheet jam, and so forth). In such examples, the media stacker may have to be removed or taken apart to allow the user to perform the foregoing user tasks, which is time-consuming and inconvenient.

Figure 1:
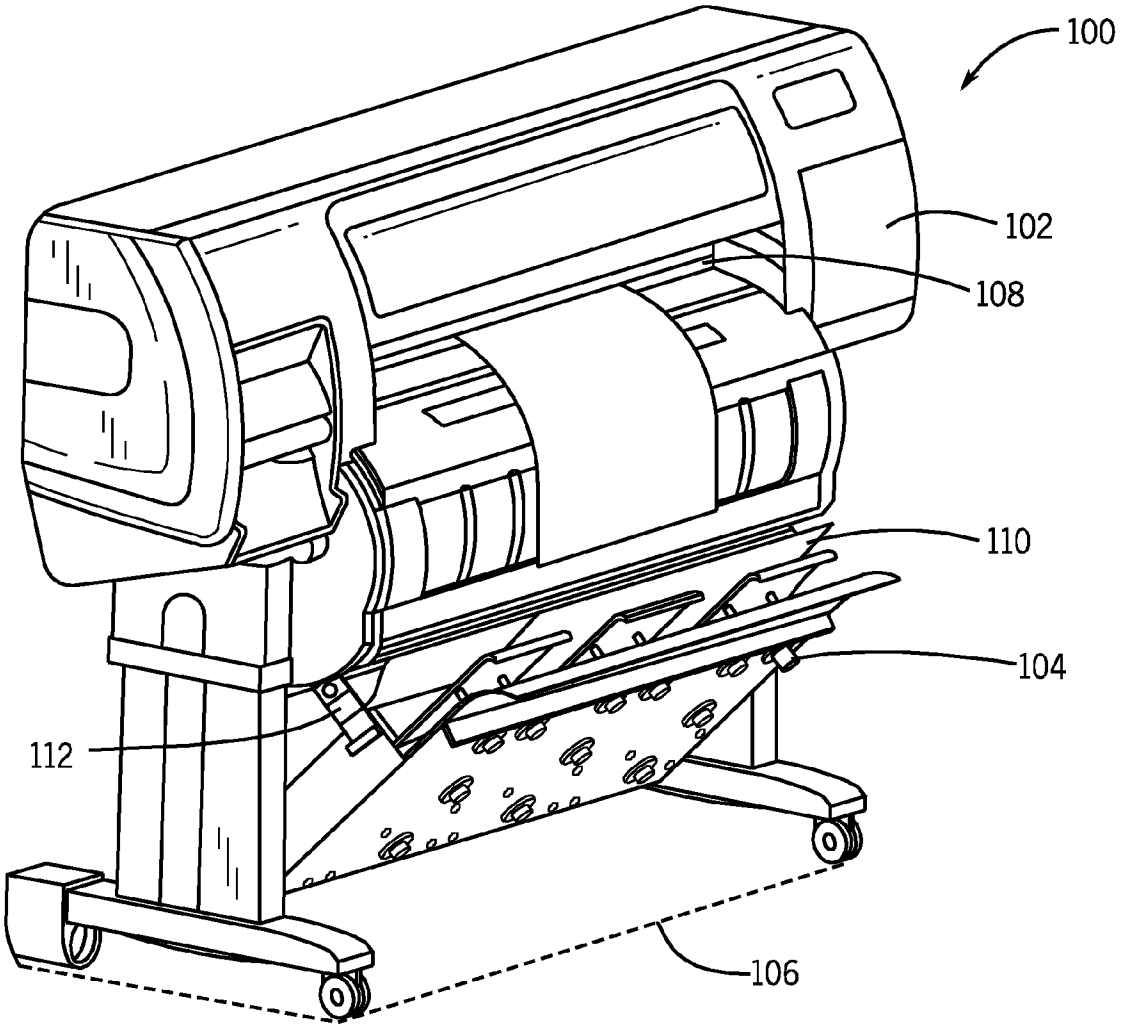
FIG. 1 is a perspective view of a printer system that has a printer and a media stacker according to some implementations.

In accordance with some implementations, a media stacker is provided that can be arranged to fit within a footprint of a printer. A "footprint" of a printer refers to an area projected onto a ground surface that is occupied by the printer. A media stacker that fits within the footprint of the printer refers to a media stacker whose size does not extend beyond the footprint once the media stacker is attached to the printer for use with the printer. In other implementations, a media stacker can extend beyond a footprint of a printer, but the portion of the media stacker that extends beyond the printer's footprint occupies less than some predefined amount (e.g. less than 10%, less than 20%, or less than some other percentage) of the printer's footprint. Although reference is made to a media stacker used with a printer in the discussion herein, it is noted that a media stacker according to some implementations can be used with other types of systems that can output media sheets FIG. 1 is a perspective view of a printer system 100 that includes a printer 102 and a media stacker 104 according to some implementations. A dashed profile 106 of the ground surface on which the printer 102 is positioned defines the footprint of the printer 102. As can be seen in FIG. 1, the media stacker 104 has a size and an arrangement with respect to the printer 102 that allows the media stacker 104 to fit within the footprint 106 of the printer 102, such that no portion of the media stacker extends beyond the printer's footprint 106.

As depicted in FIG. 1, the printer 102 has an output port 108, which in the example according to FIG. 1 is located at the front side of the printer 102 (the side of the printer 102 that a user faces during normal operation of the printer 102). A printed media sheet 110 (a media sheet on which a target pattern has been printed) that has been output from the output port 108 of the printer 102 is received in the media stacker 104. Generally, the media stacker 104 has an external housing that defines a drawer, where the drawer defines an inner chamber into which printed media sheets are received and stacked.

Figure 2:
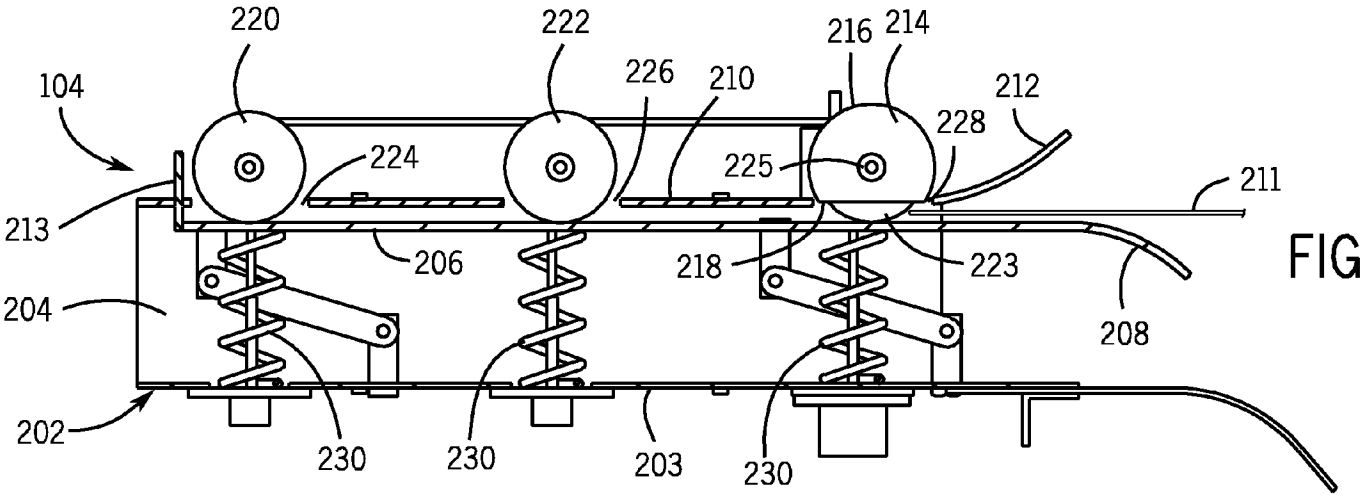
FIG. 2 is a cross-sectional view of a media stacker according to some implementations.

The media stacker 104 is attached to the printer 102 using an attachment mechanism 112 (e.g. a latch or other type of attachment mechanism). A cross-sectional view of the media stacker 104 is shown in FIG. 2. The media stacker 104 has a drawer 202 that defines an inner chamber 204 for receiving a stack of media sheets. The drawer 202 is defined by an external housing of the media stacker 104—in examples according to FIG. 2, the media stacker external housing has at least a lower housing portion 203 and an upper guide structure 210.

A media support tray 206 (for holding printed media sheets) extends into the drawer 202. The media tray 206 has a curved front portion 208 at a side of the media tray 206 that first receives a printed media sheet. The curved portion 208 is curved downwardly in the view of FIG. 2 to allow for a media sheet to be guided onto the media tray 206. A rear end of the media tray 206 has a stop 213 against which a media sheet abuts once the media sheet reaches the stop 213.

Figure 3:
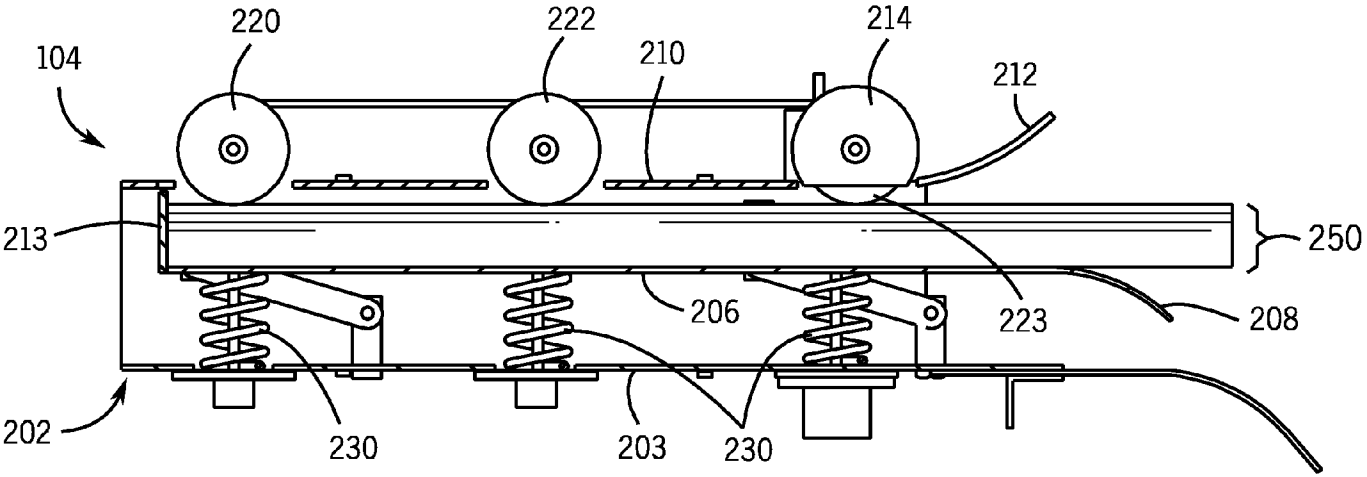
FIG. 3 is a cross-sectional view of the media stacker of FIG. 2 with stacked media sheets in a drawer of the media stacker.

The upper guide structure 210 is provided above and opposes the media tray 206. The guide structure 210 has a curved front portion 212 that is curved in a direction that is opposite the curvature of the curved portion 206. The combination of the curved portions 206 and 212 define a receptacle into which a media sheet 211 can be guided for entry into the inner chamber 204 of the drawer 202. FIG. 3 shows a stack 250 of media sheets that have been provided in the drawer 202 of the media stacker 104

The media stacker 104 includes a moving element 214 that is used to engage the media sheet 211 as the media sheet 211 is output from the printer 102 (FIG. 1). Once the moving element 214 engages the media sheet 211, the moving element 214 slides the media sheet to a target position in the drawer 202. The moving element 214 is configured to disengage from the media sheet 210 once the media sheet 210 has reached the target position.

In some implementations, the moving element 214 is a D-shape roller, which is a rotatable structure that has a circular portion 216 and a planar (or non-circular) portion 218. The circular portion 216 has an outer profile that generally follows the profile of a circle. The planar portion 218 has a generally planar surface. In other implementations, rather than a planar portion, the D-shape roller 214 can have a portion with a different non-circular shape. Generally, the D-shape roller 214 is able to engage the media sheet 211 using the circular portion 216, but is disengaged from the media sheet 211 when the planar portion 218 faces the media sheet 211.

In examples according to FIG. 2, the media stacker 104 further includes a retaining element 220 that is to engage the media sheet 211 as the media sheet 211 slides into the drawer 202. In some implementations, the retaining element 220 is a roller. The roller 220 is an idle roller (which is a roller that is not driven by any driving mechanism). On the other hand, the D-shape roller 214 is driven by a driving mechanism, such as a motor.

FIG. 2 also shows another retaining element 222 that is similar to the retaining element 220. For example, the retaining element 222 can also be an idle roller. In addition to the idle rollers 220 and 222, another idle roller 223 can also be provided. The idle roller 223 is rotatably mounted on the same support rod 225 as the D-shape roller 214. The outer diameter of the idle roller 223 is smaller than the outer diameter of the D-shape roller 214; as a result, when the D-shape roller 214 is engaged to a given media sheet, the idle roller 223 is not engaged to the given media sheet. On the other hand, when the D-shape roller 214 is disengaged from the given media sheet, the idle roller 223 is engaged to the given media sheet.

In other examples, instead of using three idle rollers 220, 222, and 223 along a particular axis as shown in FIG. 2, a different number of idle rollers can be used (e.g. less than three or greater than three).

The rollers 220, 222, and 214 (223) are provided through corresponding openings 224, 226, and 228 in the guide structure 210. As a media sheet is guided by the D-shape roller 214 into the drawer 202, the media sheet 210 is first engaged by the idle roller 222, and then later by the idle roller 220 as the media sheet 210 is further slid into the drawer 202, until the media sheet 210 reaches its target position inside the drawer 202.

The media tray 206 is biased towards the rollers 220, 222, and 214 (223). The biasing can be provided by tray springs 230, which are attached to the lower support housing portion 203 and extend vertically upwardly towards the media tray 206. Initially, when no media sheets are received in the drawer 202, the media tray 206 is biased by the springs 230 to its uppermost position. However, as media sheets are received into the drawer 202, as shown in FIG. 3, the media tray 206 is pushed downwardly by the stack 250 of media sheets to cause the springs 230 to compress.

Figure 4:
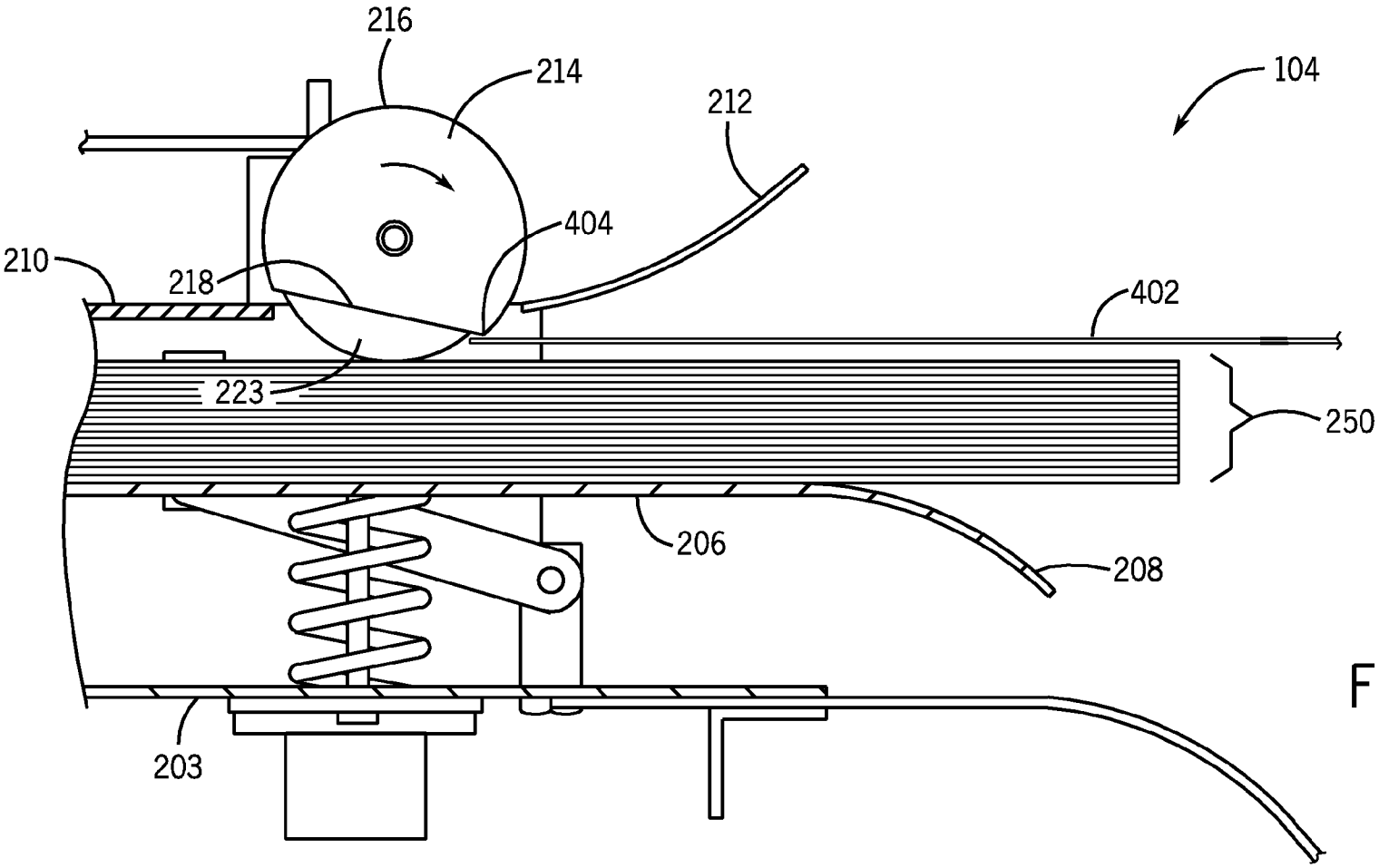
FIG. 4 is a cross-sectional view of a portion of the media stacker of FIG. 2, according to some implementations.

FIG. 4 is an enlarged view of a portion of the media stacker 104. As shown in FIG. 4, the stack 250 of media sheets has been received on the media tray 206 of the media stacker 104. As further shown in FIG. 4, a new media sheet 402 is being provided into the drawer 202. The D-shape roller 214 is rotated in a clockwise direction, with a leading edge 404 of the circular portion 216 of the D-shape roller 214 initially engaging a leading portion of the new media sheet 402. As further shown in FIG. 4, since the D-shape roller 214 is disengaged from the stack 250 of media sheets, the front idle roller 223 is engaged to the stack 250 of media sheets that are already in the drawer 202.

Figure 5:
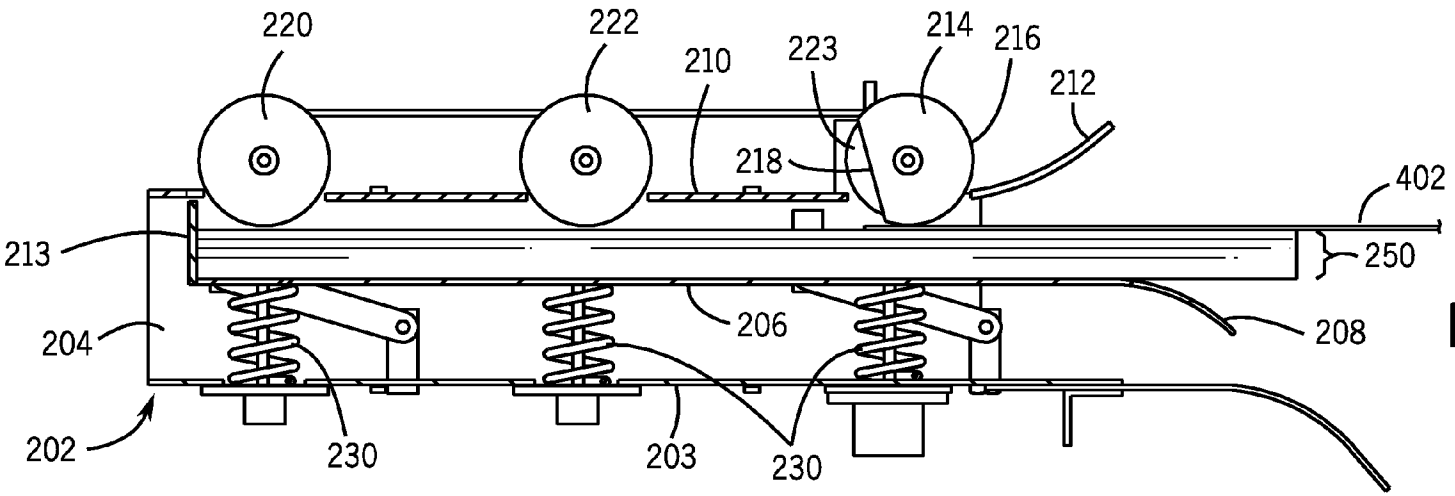
FIGS. 5 and 6 are cross-sectional views of the media stacker of FIG. 2 showing a D-shape roller of the media stacker at different positions for guiding a particular media sheet into the drawer, in accordance with some implementations.

As the leading edge 404 of the circular portion 216 of the D-shape roller 214 engages the new media sheet 402, further clockwise rotation of the D-shape roller 214 causes the new media sheet 402 to be guided further into the drawer 202, as shown in FIG. 5. Once the circular portion 216 of the D-shape roller 214 engages the new media sheet 402, the idle roller 223 is disengaged from the stack 250 of media sheets, as shown in FIG. 5.

Figure 6:
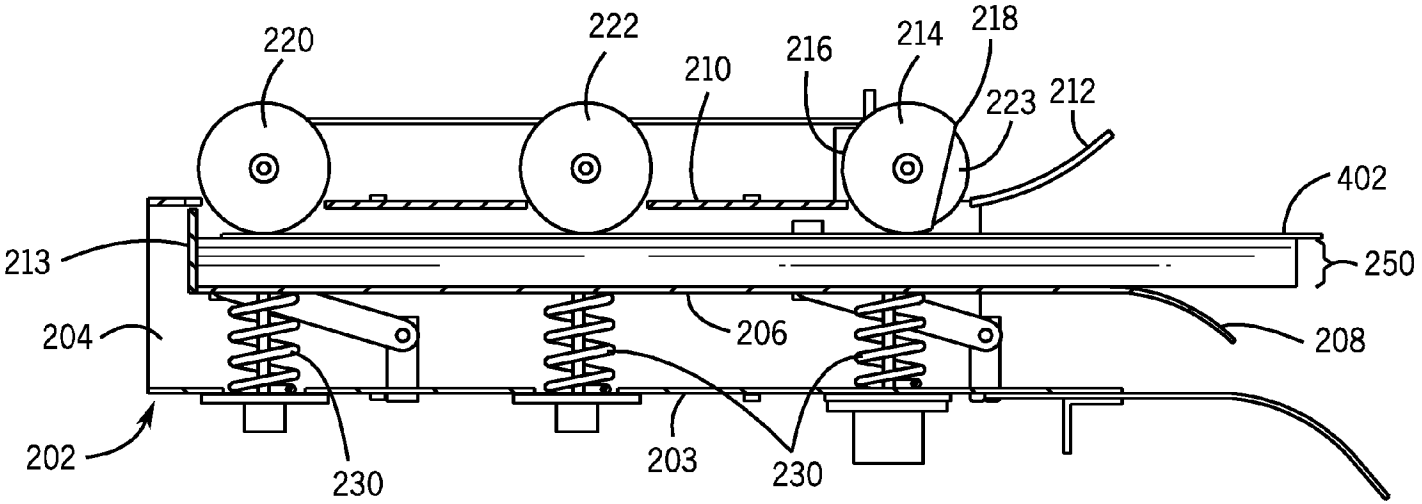

FIG. 6 shows continued clockwise rotation of the D-shape roller 214, which causes the new media sheet 402 to continue its sliding movement into the drawer 202, until the new media sheet 402 is engaged by the idle rollers 220 and 222. The new media sheet 402 continues its sliding movement caused by the D-shape roller 214 until the leading edge of the new media sheet 402 reaches the stop 213 inside the drawer 202.

At this point, when the new media sheet 402 has reached its target position (the leading edge of the new media sheet 402 engaged to the stop 213), the D-shape roller 214 has rotated to a position that the circular portion 216 is no longer engaged to the new media sheet 402, since the planar portion 218 of the D-shape roller 214 now faces the new media sheet 402.

The idle rollers 220, 222, and 223 move freely while the media sheet 402 is moving. In addition, provision of the idle rollers 220, 222, and 223 can avoid buckling of the moving media sheet 402 and the stack 250 of media sheets due to compression forces generated by the D-shape roller 214 as the D-shape roller 214 pushes the new media sheet 402 into the drawer 202.

Figure 7:
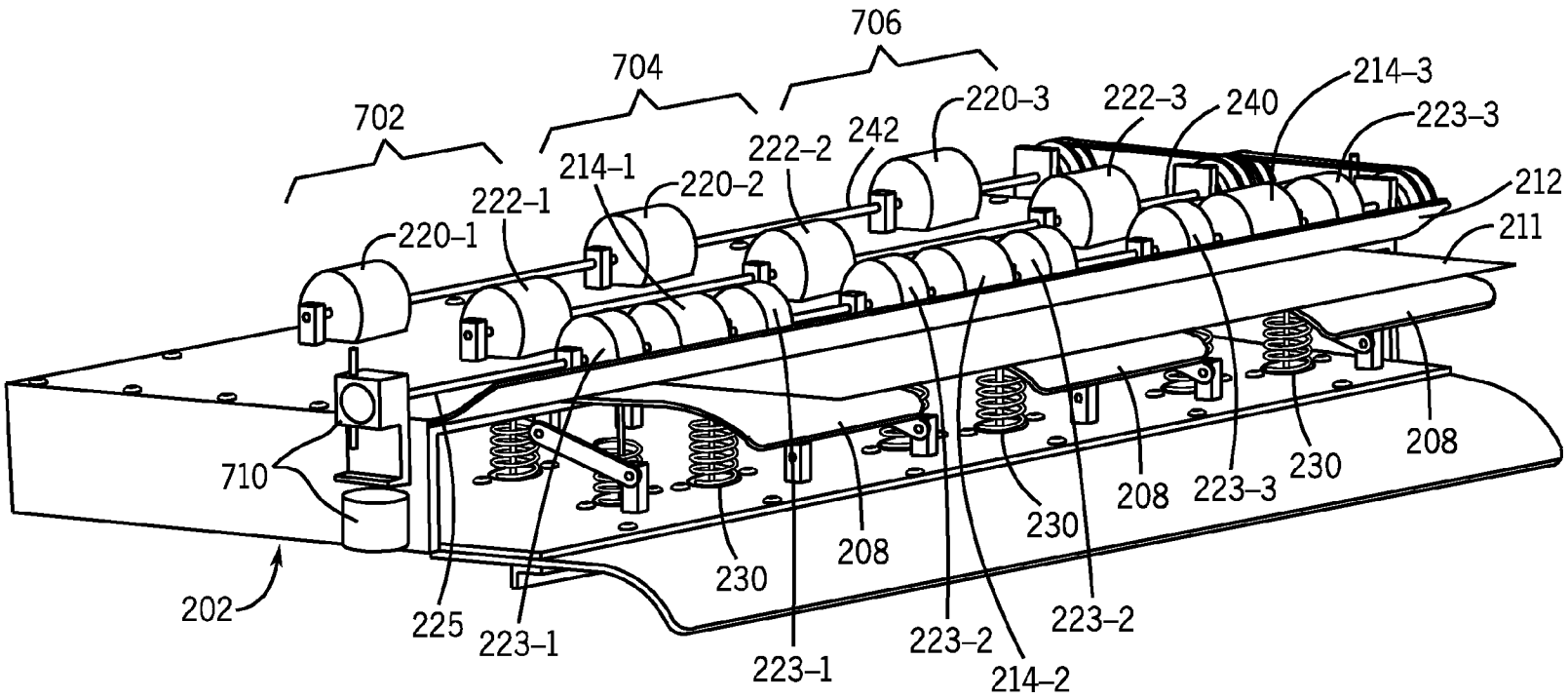
FIG. 7 is a perspective view of components of the media stacker according to some implementations.

FIG. 7 is a perspective view of portions of the media stacker 104. As shown in FIG. 7, three sets 702, 704, and 706 of rollers 220, 222, 223, and 214 are provided generally at three different lateral locations. The set 702 includes idle rollers 220-1, 222-1, and 223-1, and a driven roller 214-1 (similar to the rollers 220, 222, 223, and 214 discussed above). The set 704 includes idle rollers 220-2, 222-2, and 223-2, and a driven roller 214-2. The set 706 includes idle rollers 220-3, 222-3, and 223-3, and a driven roller 214-3. By employing multiple sets of the rollers 220, 222 and 223, and 214, the media stacker 104 can be configured to receive media sheets of different sizes as well as to handle a mixture of media sheets of different sizes. As shown in FIG. 7, the rollers 223 and 214 (223-1, 223-2, 223-3, 214-1, 214-2, and 214-2 shown) in the multiple sets 702, 704, and 706 are all mounted on the support rod 225. Similarly, the idle rollers 222 (222-1, 222-2, 222-3 shown) in the multiple sets 702, 704, and 706 are rotatably mounted on a support rod 240, and the idle rollers 220 (220-1, 220-2, 220-3 shown) in the multiple sets 702, 704, and 706 are rotatably mounted on a support rod 242.

FIG. 7 also shows an example motor assembly 710 that has a motor for rotating the support rod 225. The driven rollers 214-1, 214-2, and 214-3 are fixedly attached to the support rod 225 such that rotation of the support rod 225 causes rotation of the driven rollers 214-1, 214-2, and 214-3. On the other hand, the idle rollers 223-1, 223-2, and 223-3 are freely rotatably mounted with respect to the support rod 225 such that rotation of the support rod 225 does not cause rotation of the idle rollers.

Figure 8:
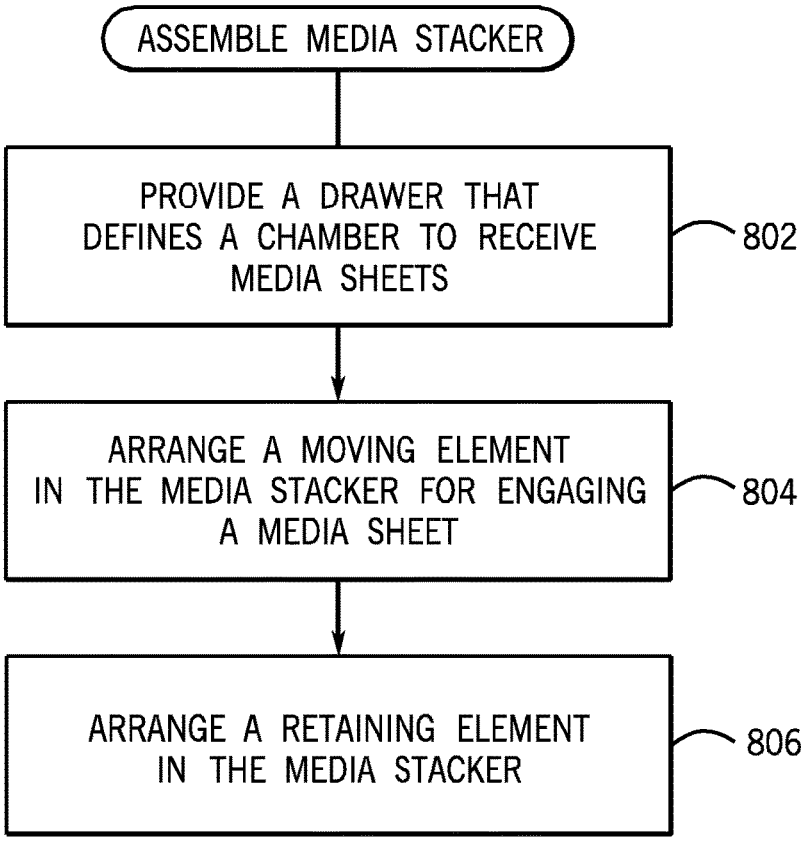
FIG. 8 is a flow diagram of assembling a media stacker according to some implementations.

FIG. 8 is a flow diagram of a process of assembling a media stacker according to some implementations. The process of FIG. 8 can be performed by a manufacturer or by any other entity that is able to assemble a media stacker. The process provides (at 802) a drawer that defines a chamber to receive media sheets from a printer. The process further arranges (at 804) a moving element in the media stacker, where the moving element is to engage a particular media sheet as the particular media sheet is output from the printer and received in the media stacker. As examples, the moving element can be the D-shape roller 214 discussed above. The process also arranges (at 806) a retaining element (e.g. idle roller 220 and/or 222 and/or 223) in the media stacker to engage the particular media sheet as the particular media sheet is guided into the drawer.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

What is claimed is:

1. A media stacker comprising:

a drawer defining a chamber;

a plurality of driven rollers to engage media sheets of different sizes as the media sheets are output from a system, the plurality of driven rollers to slide the media sheets to a target position in the drawer, and the plurality of driven rollers to disengage from the media sheets once the media sheets have reached the target position;

a plurality of idle first rollers;

a support rod, the plurality of driven rollers and the plurality of idle first rollers mounted on the support rod; and a plurality of retaining elements to engage the media sheets of the different sizes as the media sheets slide into the drawer.

2. The media stacker of claim 1, wherein the media stacker has a size to fit within a footprint of the system.

3. The media stacker of claim 1, wherein each driven roller of the plurality of driven rollers is a D-shape roller.

4. The media stacker of claim 3, wherein the idle first rollers are to engage a given media sheet when the driven rollers disengage from the given media sheet, and the idle first rollers are disengaged from the given media sheet when the driven rollers engage the given media sheet.

5. The media stacker of claim 4, wherein the idle first rollers each has an outer diameter that is smaller than an outer diameter of each of the driven rollers.

6. The media stacker of claim 1, further comprising a support tray having at least a portion in the drawer, wherein the support tray is to support the media sheets.

7. The media stacker of claim 1, wherein the drawer has a stop to engage the media sheets at the target position.

8. The media stacker of claim 1, wherein successive driven rollers of the plurality of driven rollers are spaced apart along a length of the support rod.

9. The media stacker of claim 8, wherein the plurality of retaining elements comprise a plurality of idle second rollers, the media stacker further comprising another support rod, the plurality of idle second rollers mounted on the another support rod, wherein successive idle second rollers of the plurality of idle second rollers are spaced apart along a length of the another support rod.

10. A printing system comprising:

a printer having an output port through which printed media sheets of different sizes are output; and a media stacker attached to the printer, the media stacker comprising:

a drawer defining a chamber to receive the media sheets of different sizes;

a plurality of driven rollers to engage the media sheets of different sizes as the media sheets are output from the printer, the plurality of driven rollers to slide the media sheets to a target position in the drawer, and the plurality of driven rollers to disengage from the media sheets once the media sheets have reached the target position;

a plurality of idle first rollers;

a support rod, the plurality of driven rollers and the plurality of idle first rollers mounted on the support rod; and a plurality of idle second rollers to engage the media sheets of the different sizes as the media sheets slide into the drawer.

11. The printing system of claim 10, wherein the media stacker has a support tray having a portion extending into the drawer, the support tray to support the media sheets.

12. The printing system of claim 10, wherein the driven rollers are driven by a motor, and the idle first rollers are not driven by a motor.

13. The printing system of claim 10, wherein the driven rollers include D-shape rollers.

14. The printing system of claim 13, wherein each D-shape roller of the D-shape rollers has a circular portion to engage a given media sheet, and a non-circular portion to cause the D-shape roller to be disengaged from the given media sheet once the given media sheet has reached the target position.

15. The printing system of claim 13, wherein the idle first rollers each has an outer diameter that is smaller than an outer diameter of each of the driven rollers.

16. The printing system of claim 10, further comprising another support rod, wherein the idle second rollers are mounted on the another support rod and are spaced apart from one another along a length of the another support rod.

17. A method comprising:

providing a drawer of a media stacker;

arranging a plurality of driven rollers in the media stacker, wherein the plurality of driven rollers engage media sheets of different sizes as the media sheets are output from a printing system, the plurality of driven rollers to slide the media sheets to a target position in the drawer, and the plurality of driven rollers to disengage from the media sheets once the media sheets have reached the target position;

mounting the plurality of driven rollers and a plurality of idle first rollers on a common support rod; and arranging a plurality of retaining elements in the media stacker to engage the media sheets of different sizes as the media sheets are guided into the drawer.

18. The method of claim 17, wherein gaps are provided between successive driven rollers of the plurality of driven rollers along the support rod.

19. The method of claim 18, wherein the plurality of retaining elements comprise a plurality of idle second rollers, the method further comprising rotatably arranging the plurality of idle second rollers on another support rod such that gaps are provided between successive idle second rollers of the plurality of idle second rollers along the another support rod.

20. The method of claim 17, wherein the plurality of driven rollers comprise D-shape rollers, and wherein the idle first rollers each has an outer diameter that is smaller than an outer diameter of each of the driven rollers.

* * * * *